US011224771B2

(12) United States Patent
Bryntesen et al.

(10) Patent No.: US 11,224,771 B2
(45) **Date of Patent: *Jan. 18, 2022**

(54) APPARATUS, COMPONENTS, METHODS AND TECHNIQUES FOR CONTROLLING EQUIPMENT OPERATION

(71) Applicant: C.J. Spray, Inc., Eagan, MN (US)

(72) Inventors: Chris Bryntesen, Eagan, MN (US); Scott Henderson, Lakeville, MN (US); Jason Botten, Elko, MN (US)

(73) Assignee: C.J. Spray, Inc., Eagan, MN (US)

( * ) Notice: Subject to any disclaimer, the term of this patent is extended or adjusted under 35 U.S.C. 154(b) by 56 days.

This patent is subject to a terminal disclaimer.

(21) Appl. No.: 16/778,586

(22) Filed: Jan. 31, 2020

(65) Prior Publication Data

US 2020/0276460 A1 Sep. 3, 2020

Related U.S. Application Data

(63) Continuation of application No. 14/810,969, filed on Jul. 28, 2015, now Pat. No. 10,549,131.

(60) Provisional application No. 62/030,494, filed on Jul. 29, 2014.

(51) Int. Cl.
*A62B 9/00* (2006.01)
*A62B 7/10* (2006.01)

(52) U.S. Cl.
CPC ..... *A62B 9/006* (2013.01); *A62B 7/10* (2013.01)

(58) Field of Classification Search
CPC ..... A62B 9/006
See application file for complete search history.

(56) References Cited

U.S. PATENT DOCUMENTS

| | | | | |
|---|---|---|---|---|
| 4,767,913 | A | 8/1988 | Weber | |
| 5,315,289 | A | 5/1994 | Fuller | |
| 9,027,849 | B2 | 5/2015 | Lind | |
| 10,549,131 | B2 | 4/2020 | Bryntesen et al. | |
| 2005/0189437 | A1 | 9/2005 | Alexander | |
| 2009/0065489 | A1 | 3/2009 | Duffy | |
| 2012/0266889 | A1 | 10/2012 | Roberts | |
| 2013/0092164 | A1 | 4/2013 | Curran | |
| 2014/0152468 | A1 | 6/2014 | Obenchain | |
| 2015/0224524 | A1* | 8/2015 | Roide | F04C 13/002 239/71 |
| 2015/0283409 | A1 | 10/2015 | Buck | |
| 2016/0271428 | A1 | 9/2016 | Ehler | |

* cited by examiner

*Primary Examiner* — Jan Christopher L Merene
*Assistant Examiner* — Cana A Gallegos
(74) *Attorney, Agent, or Firm* — Merchant & Gould P.C.

(57) ABSTRACT

Apparatuses, components, methods, and techniques for altering equipment operation are provided. An example tool control and breathable air delivery system includes equipment including a tool and a controller configured to control the tool. The example system also includes a wearable respirator and an air delivery device connected to the wearable respirator. The example system further includes an air evaluation monitor configured to generate a signal based upon a condition of air being delivered to the wearable respirator. An example electronic circuit is configured to adjust the tool based at least in part on the signal generated by the air evaluation monitor. An example method includes enabling the tool, providing air to a respirator, determining a condition of the air, and adjusting the tool based on the condition of the air.

13 Claims, 12 Drawing Sheets

APPARATUS, COMPONENTS, METHODS AND TECHNIQUES FOR CONTROLLING EQUIPMENT OPERATION

CROSS REFERENCE TO RELATED APPLICATIONS

This application is a continuation application of U.S. application Ser. No. 14/810,969, filed Jul. 28, 2015, now U.S. Pat. No. 10,549,131. U.S. application Ser. No. 14/810,969 claims priority to U.S. Ser. No. 62/030,494, filed on Jul. 29, 2014. A claim of priority is made to each of the above referenced applications, to the extent appropriate. The disclosures of the above referenced applications are incorporated herein by reference in their entirety.

FIELD OF THE DISCLOSURE

The present disclosure relates to the operation of equipment at worksites. The equipment can, for example, include a tool. Examples of the equipment include material application equipment, including equipment for the application of insulating foam and/or various coatings, or other types of equipment that include for example a tool. The techniques relate to operation of the equipment when personnel at the worksite also are equipped with breathing protection such as respirator equipment. The methods described relate to linking operation of the respirator equipment system to operation of the equipment system in a desirable manner, so that if the respirator system operation is not determined to be adequate or appropriate, function of the tool or equipment is automatically modified.

BACKGROUND

Equipment is often used at worksites for various purposes. The equipment often includes a tool that is connected with a communication line (e.g., an air line, a hydraulic line, a vacuum line, a power line, or another type of feed line). The tool is often portable and is carried by personnel at the worksite to be used in various locations. In many instances, personnel operating the mobile portion of the equipment at the construction site are required to wear respirator equipment (e.g., respiratory or breathing protection equipment).

For example, distribution or application of materials at worksites is a common practice. The application may involve, for example, spray application of insulation foam at a construction site or application of various protective coatings to materials or structures. The equipment for such applications is often positioned on a movable platform or rig, which can be moved to the construction site of interest. Tools (applicators such as spray guns or other distributors or other tool types) are often carried by work personnel through various locations of the worksite, to conduct the material application. The tools are connected by communication lines, such as flexible feed hoses back to the mobile platform or rig, which can be quite remote, relative to the tool. The distance of separation between the personnel and the mobile rig, while making material applications, can be as much as fifty feet to several hundred feet, or more.

In many instances, personnel operating the tool at the construction site are required to wear respirator equipment (e.g., respiratory or breathing protection equipment). The respirator equipment is often a protective mask or hood to which breathable air is provided from a pump arrangement, which is also often positioned remote to the worker, for example on the mobile platform or rig.

In some instances, air reaching the personnel through the respirator system can become substandard. The present application relates to methods, techniques and equipment for desirable operation of the equipment system when a substandard air quality condition is detected for the respirator equipment or system.

SUMMARY

In accord with the present disclosure, in general the techniques characterized herein relate to providing a system in which a link is provided between a respirator system and equipment (e.g., material application equipment), such that if an undesired air quality is detected in the respirator system, the equipment is automatically subject to shut down or modification in operation. In many applications, the techniques according to the present disclosure can be applied to an already existing system but in which no such link currently exists.

For example, the equipment may be configured to receive one or more monitor signals (e.g., to monitor temperature at the tool) or communication signals. The techniques of the present disclosure can be incorporated to interrupt one of the monitor signals or one of the communication signals, causing an error condition on the equipment, when a substandard air quality condition is detected for the respirator. In response to this error condition, the equipment may disable or otherwise adjust the tool, and thus capture the attention of the personnel operating the equipment. Although alternatives are possible, the monitor signal may be interrupted based on an alarm signal generated by an air quality monitor upstream of the respirator equipment.

Alternatively, the equipment may be configured to receive an air quality signal.

Similarly, the air quality monitor may be configured to generate an air quality signal. The signal from the air quality monitor can then be communicated to the equipment. In this manner, if the air quality monitor detects a substandard air quality condition for the respirator, the equipment can respond appropriately. Although alternatives are possible, the equipment can disable the tool or otherwise notify the personnel operating the tool of the substandard air quality condition.

DETAILED DESCRIPTION

I. General Principles

A. Further General Description

Figure 1:
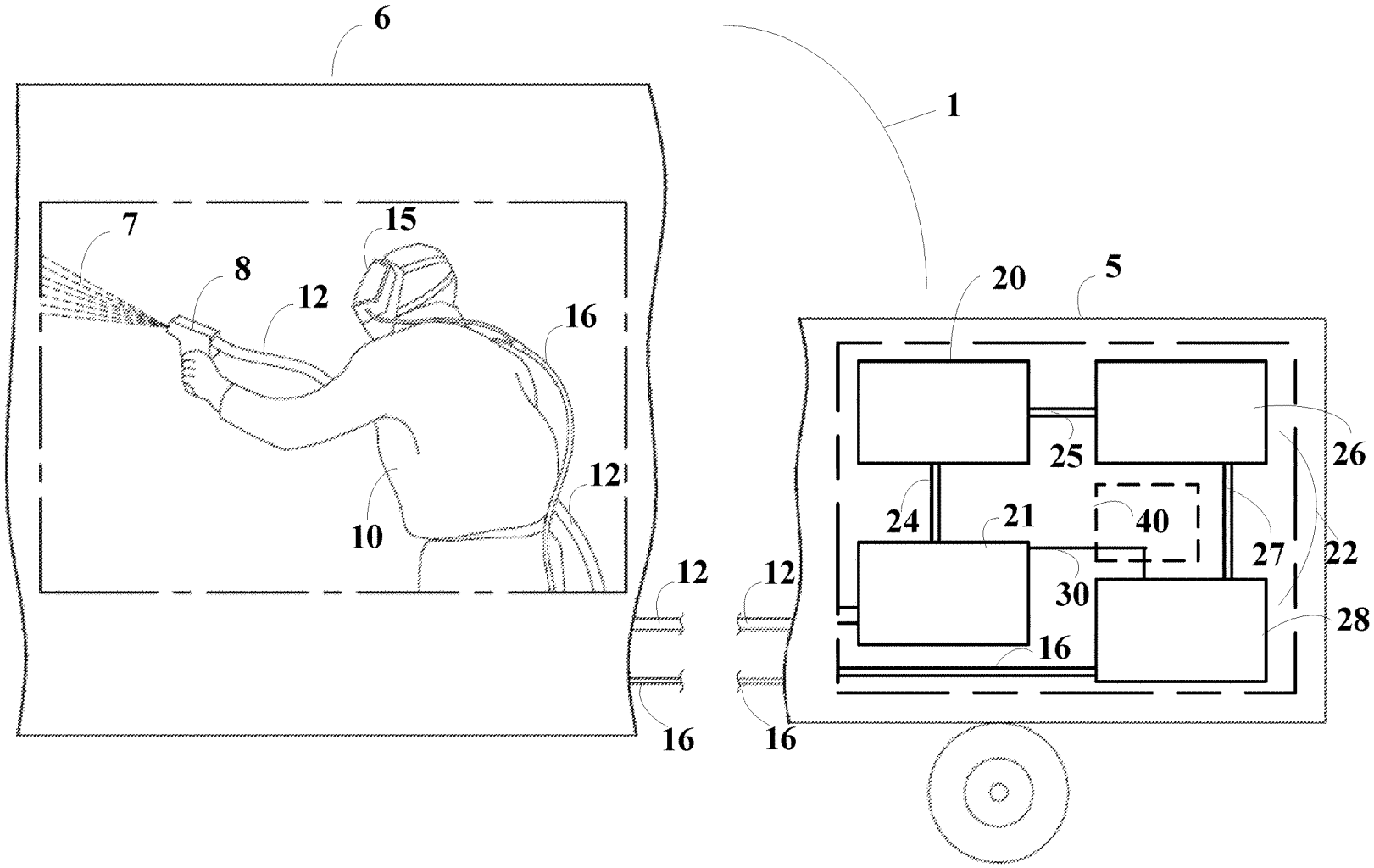
FIG. 1 is a fragmentary schematic view depicting a mobile application platform or rig at a construction site with personnel, remote from the application rig, applying material fed from the application rig; the personnel is shown wearing respirator equipment.

In general, the techniques described herein can be applied to various equipment used at a worksite, for example, a construction site or factory. The equipment may include a tool component that is carried by personnel to specific locations of interest in the worksite. Examples of the equipment include material applicators and other types of equipment (such as welding equipment). Example tools include applicators (spray guns or other distributors) and other types of tools such as those used for welding, grinding, drilling, or tools that include a communication line. Example material applicators include spray applicators and other types of applicators.

The examples described herein often relate to the application of material at a worksite.

However, it should be understood, that the techniques described can be applied to various other tools as well. In general, a variety of materials are applied at worksites such as construction sites. Examples include: application of insulation foam, for example with spray equipment; and, application of protective coatings such as water barriers or weather coatings. In many instances, the application equipment along with barrels or other storage containers of the material(s) to be applied, is positioned on a mobile platform or rig, such as a trailer or truck bed. The equipment is moved to the construction site of interest, and a tool such as an applicator (spray gun or other distributor) is carried by application personnel through to specific locations of interest, with material fed from the mobile platform to the tool (applicator) via a communication line (flexible hose arrangement). Thus, the application personnel can move through the worksite of interest carrying the tool while maintaining a feed of the material(s) to be applied through the flexible hose arrangement.

Dispensing equipment positioned on the mobile platform generally involves operational interaction of: material (source) container(s); a power system; compressor equipment; and, dispensing equipment for managing the material involved. Mobile platforms, such as mobile trucks or trailers are assembled and provided by companies such as CJ Spray of Eagan, Minn. 55121, the Assignee of the present application. Dispensing equipment for managing and controlling material delivery is manufactured by a variety of companies, including for example, Graco, Inc. of Minneapolis, Minn. 55413 and Polyurethane Machinery Corporation of Lakewood, N.J. 08701.

The material dispensing equipment can include a variety of control and monitoring systems, for example to manage temperature and content of the material being applied. Shutoff systems are typically included, configured to stop or modify material flow and application, if an undesired condition (such as temperature or material status) is detected by the control arrangement. Alternatively or additionally, some embodiments of the material dispensing equipment include one or more communication systems that communicate with other equipment. The shutoff systems may also be configured to interrupt material flow if the communication systems are interrupted. Further, the material dispensing equipment may be configured to display an error message or code upon interruption of the communication system or detection of an undesired condition. For example, if the communication system is interrupted the material dispensing equipment may stall (or interrupt) material flow and display an communications error information. The error information may be descriptive such as COMMUNICATIONS ERROR or may be a code such as E99 (which may be understood with reference to a troubleshooting guide or user manual).

In many instances, personnel using a tool such as an applicator (or other equipment) are required to wear respirator (breathing) protection equipment. A variety of such systems have been used. Typical ones involve some form of mask or hood arrangement connected by an air flow line, ultimately to an air source. Typically, the air source is a compressor arrangement or another air delivery device mounted on the mobile platform and is connectable to a wearable respirator such as the respirator mask or hood. The respirator mask or hood may be fed air through one or more flexible air lines that connect to the air source and are independent of the material equipment dispensing lines or other lines running to the equipment. In a typical application, respirator air from an air compressor positioned on the mobile platform is directed through a filtration system, and then through a step down or pressure regulator before being fed to the mask or hood. Respirator safety equipment for such uses is provided by a variety of companies. Examples include Bullard of Cynthiana, Ky. 41031; Martech Services Company, of Mazeppa, Minn. 55956; Allegro Industries of Piedmont, S.C. 29673; Air Systems Inc. of Chesapeake, Va. 23320; and 3M Co. of St. Paul, Minn. 55144.

In some instances, even after filtration, air in the respirator system may be unacceptably contaminated. Indeed, typical respirator systems for use with equipment operation techniques according to the present disclosure, are generally provided with an air quality monitor downstream of the filtration equipment and upstream of the breather mask or hood.

In some instances, the respirator air filtration equipment may be positioned on the mobile platform or rig, along with the material application equipment (or other equipment) and air compressor. In others, it may be in a portable arrangement carried by or with the personnel, remote from the mobile platform. In either instance, an issue arises as to warning the personnel of an undesired status of the air quality in the respirator equipment. For example, in some systems, an audible alarm is provided that is triggered when the air quality sensing equipment detects an undesirable air quality. If the alarm system is positioned back with a mobile platform, however, it may be of little use in warning the remote personnel. Even if positioned with or near equipment remote to the mobile platform or rig, but near the personnel, noise or other distraction in the environment where the equipment is being operated may inhibit or delay the personnel receiving the important warning.

A visual display alarm suffers similar shortcomings. Whether at the remote site or on equipment with or near the personnel, there may be an unacceptable period of time that passes before the personnel is in a positon to notice the alarm.

In addition, government agency safety regulations for equipment operation and worksite may be at issue. In particular, the government regulations may manage the types of warnings that the personnel must be provided with, or the time period or conditions under which warning practice are acceptable. Thus, failure to provide and heed these warnings, may not only result in injury to personnel, but, in some instances, violation of regulation or law.

Techniques and equipment are described herein, which link operation of the equipment (e.g., the application equipment) to the respirator equipment such that when air quality monitoring detects an undesirable air quality in the respirator system, operation of the equipment is automatically shut-off or otherwise modified (affected). This will generate a set of conditions that will immediately or almost immediately gain the attention of the personnel, because the equipment will have ceased working normally or undergone a noticeable change in operation. Typically, and preferably, the system is configured such that immediately upon investigating the cause of the equipment operation modification, the personnel will observe that it is the respirator system monitor that caused the modification, and appropriate steps can be taken to achieve proper respirator system operation, to allow restarting (or proper continuation of) the equipment operation system. A variety of specific applications of the techniques are possible, as will be understood from the following.

B. An Example of the Techniques and a System of Use

A typical system of use and application of techniques according to the present disclosure can be understood from reference to FIGS. 1-8. FIGS. 1-8 relate to an example involving material application equipment. The techniques and systems described herein are applicable to other types of equipment as well. Referring first to FIG. 1, a schematic depiction of a mobile worksite location with a mobile material application platform or rig and remote application site and personnel is provided. Referring to FIG. 1, at 1, the system is generally indicated. A mobile application platform or rig is indicated generally at 5. The mobile application platform or rig may, for example, be a trailer or a truck bed, generally configured to be moved to a worksite where material application is needed. Again, such equipment can be obtained, for example, from CJ Spray of Eagan, Minn. 55121, the Assignee of the present application. The mobile application equipment would typically include, provided therewith, at least the following: one or more material containers for the material to be applied; a compressor arrangement and generation (generator) set for operation of the equipment; control equipment for the material application; respirator equipment; and various hoses and tools such as applicators.

Indicated in FIG. 1, at 6, a construction site location remote from the mobile platform or rig 5 is depicted, with material 7 being applied from a tool 8 such as a dispensing arrangement or applicator dispenser or gun upon selected operation by application personnel 10. At 12, a material feed line is shown directing a material to be applied from the mobile application platform or rig 5 to the tool 8 such as applicator dispenser.

By the indication of a single line 12, it is not meant to be suggested that all applications involve feed of liquid through a single line. In some instances, for example, the material feed line(s) may comprise multiple feed channels, for example with materials mixed at the dispenser 8 during application.

In the depiction of FIG. 1, the application personnel 10 is shown wearing respirator (breathing) equipment 15, in the form of a mask or hood. Air feed to the respirator equipment is shown via line 16. In the example depicted, the respirator air is directed ultimately from the mobile equipment platform or rig 5. Herein, when the general term "respirator equipment" is used in the context of the equipment worn by the application personnel, reference is meant to whatever breathing system is provided, whether in the form of a mask, hood, or some other variation.

Again, the application personnel 10 may be quite some distance from the mobile equipment platform or rig 5 during the course of a material application. There may, for example, be several hundred feet separating them, as well as portions of buildings or other materials and/or equipment construction sites. Thus, the application personnel 10 might not be in a good position to receive any type of audible or visual signal from the platform or rig 5, during the dispensing operation. Further, the environment can be quite noisy, for example, due to the operation of compressors, generators, or pumps in association with the mobile rig or platform 5, noise from the dispensing itself, and also other noise at the construction site from other operations. Thus, even if working relatively close to the platform 5, the personnel 10 may not be in a good position to receive such an audible signal. Also, in some instances, the personnel may be wearing ear plugs or protection, or a hood which tends to dampen sound. Further, the hood or mask may limit peripheral vision with respect to spotting visual signals or warnings.

Referring still to FIG. 1, selected equipment positioned on the mobile platform or rig 5, is shown schematically. The equipment depicted includes an air compressor 20, which, for the example system, is positioned in use to provide compressed air for operation of both material dispensing and control equipment 21 and respirator air system 22.

Still referring to FIG. 1, the compressor arrangement 20 may, for example, be operated with a portable generator or other equipment. Via line 24, the compressor arrangement 20 is shown communicating with material dispensing equipment 21, which is positioned to control distribution of material from a material storage container arrangement, such as barrel(s) (not shown). Together, the compressor 20 and material dispensing equipment 21 are configured to direct material via conduit arrangement (line) 12 to remote location 6 and the dispenser or distributor 8.

It is noted that the material dispensing and control equipment 21 may be configured to:

mix materials in a preferred amount; manage application temperature and rate; and/or manage other issues relating to the material. The equipment typically includes various material condition monitoring systems, with a central arrangement to shutoff or modify distribution of material through line 12 if an undesired material status is determined. As indicated above, such dispensing equipment is available from a variety of manufactures, including for example, from Graco, Inc. of Minneapolis, Minn. 55413 and Polyurethane Machinery Corporation of Lakewood, N.J. 08701.

Still referring to FIG. 1, at line 25, compressed air from the compressor 20 is shown being directed into the respirator system 22. Although alternatives are possible, the respirator system 22 may include a filtration system 26 and an respirator air quality monitoring system 28. In the particular example depicted, the respirator air is shown directed to the filtration system 26 positioned on the mobile platform 5 and then to the respirator air quality evaluation (monitoring) system 28 before being directed through conduit (line) 16 to the respirator system 15 worn by the personnel 10. The air quality monitoring system 28 is positioned to measure the quality of air received from the filtration system 26 in the example shown via line 27, which will then be provided to the breather masks or hood 15 via line 16. In some examples, the air quality monitoring system 28 and the filtration system 26 are packaged together. It is noted that the air quality monitor 28 may be provided with a visual or audible indicator, to provide signaling if the quality of air passing therethrough is not perceived as adequate for proper operation of the respirator 15. Again, an issue is that the application personnel 10 may not be in a good position to perceive any such indication that an undesired air quality status has been detected.

In a typical mobile application platform or rig 5, the dispensing system 21 and the respirator air system 22 are generally isolated from one another, except, in some instances, for both being operated with air from the same air compressor system 20 and perhaps each being powered by the same power source. However, in FIG. 1, at 30, an additional (control) link is depicted between the two systems, in accord with techniques of the present disclosure. In some approaches, the control link 30 includes control equipment 40. A general concept of the present disclosure is that the material application system 21 is shut down or otherwise modified, if an undesired air quality status is detected by the monitoring system 28 in the respirator system 22. This shut down or other modification would provide an immediate indication to the remote personnel 10 of an issue that would be difficult to miss. A variety of approaches to accomplishing this concept are characterized herein below.

Figure 2:
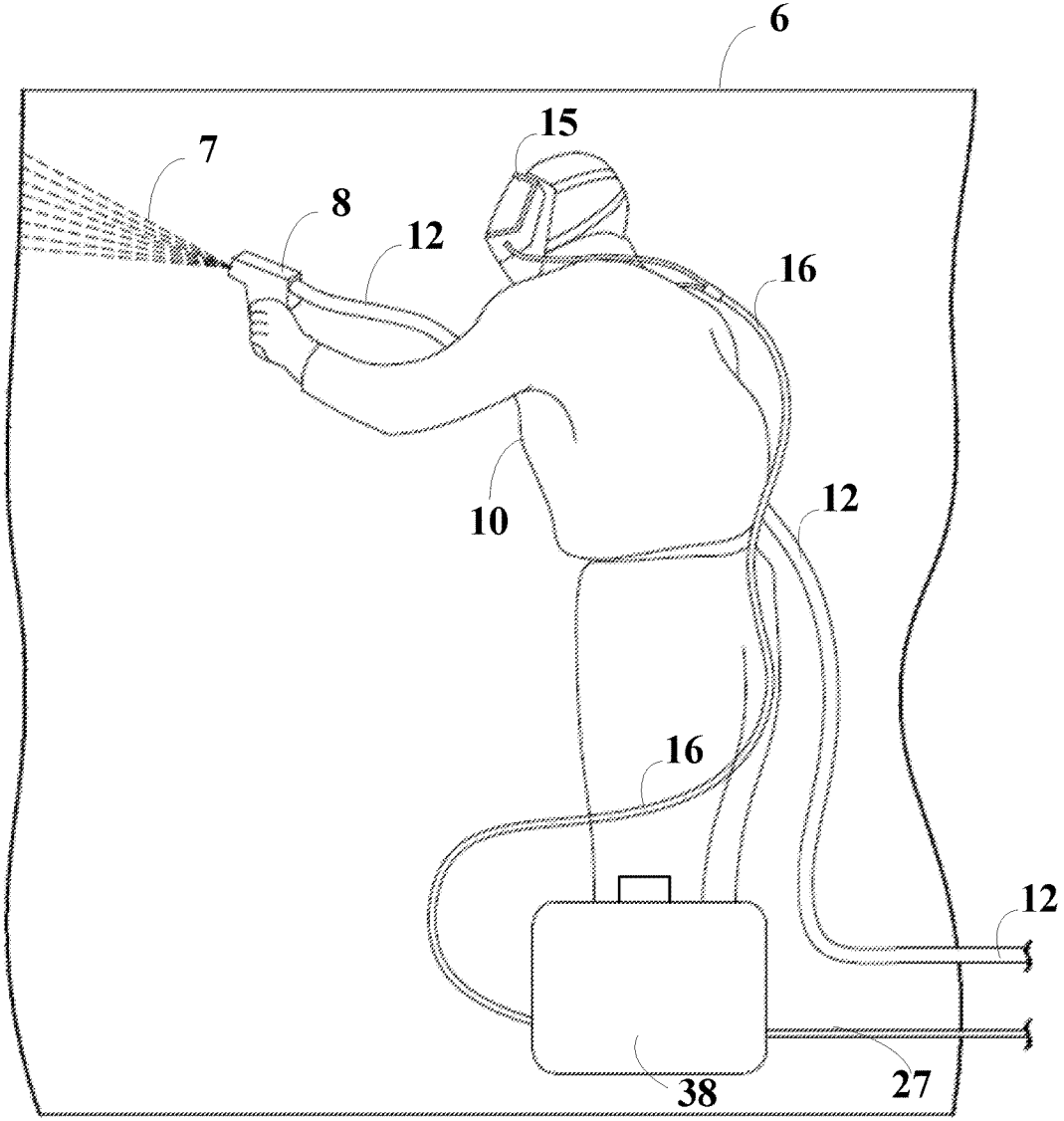
FIG. 2 is an enlarged fragmentary view of the personnel conducting a material application, while wearing a variation in respirator equipment from that shown in FIG. 1.

As referenced generally above, in some systems, a portion of the air filtration equipment may be positioned remote to the platform or rig 5, for example carried by or near the application personnel 10 during remote material application. An example of this is shown in FIG. 2. Here, the monitoring system 28 is shown carried in a case that is moved as application personnel 10 move through the construction site. Even though the case 38 may include a visual or audible signal, it would be easy for the personnel 10 to not hear or see the indicator alarm during the application process, for at least some potentially significant period of time. In some examples, the case can also include the filtration system 26 or other respirator system components.

C. A First Example Application of Techniques According to the Present Disclosure; Retro-Fitting Control Equipment for Respiratory Operation/Shutdown to Existing Equipment In accord with the present disclosure, and as indicated above, in general the techniques characterized herein relate to providing a system in which a control link is provided between a respirator system and equipment (e.g., material application equipment), such that if an undesired air quality is detected in the respirator system, the equipment is automatically subject to shut down or modification in operation. In many applications, the techniques according to the present disclosure can be applied to an already existing system but in which no such link currently exists.

Figure 3:
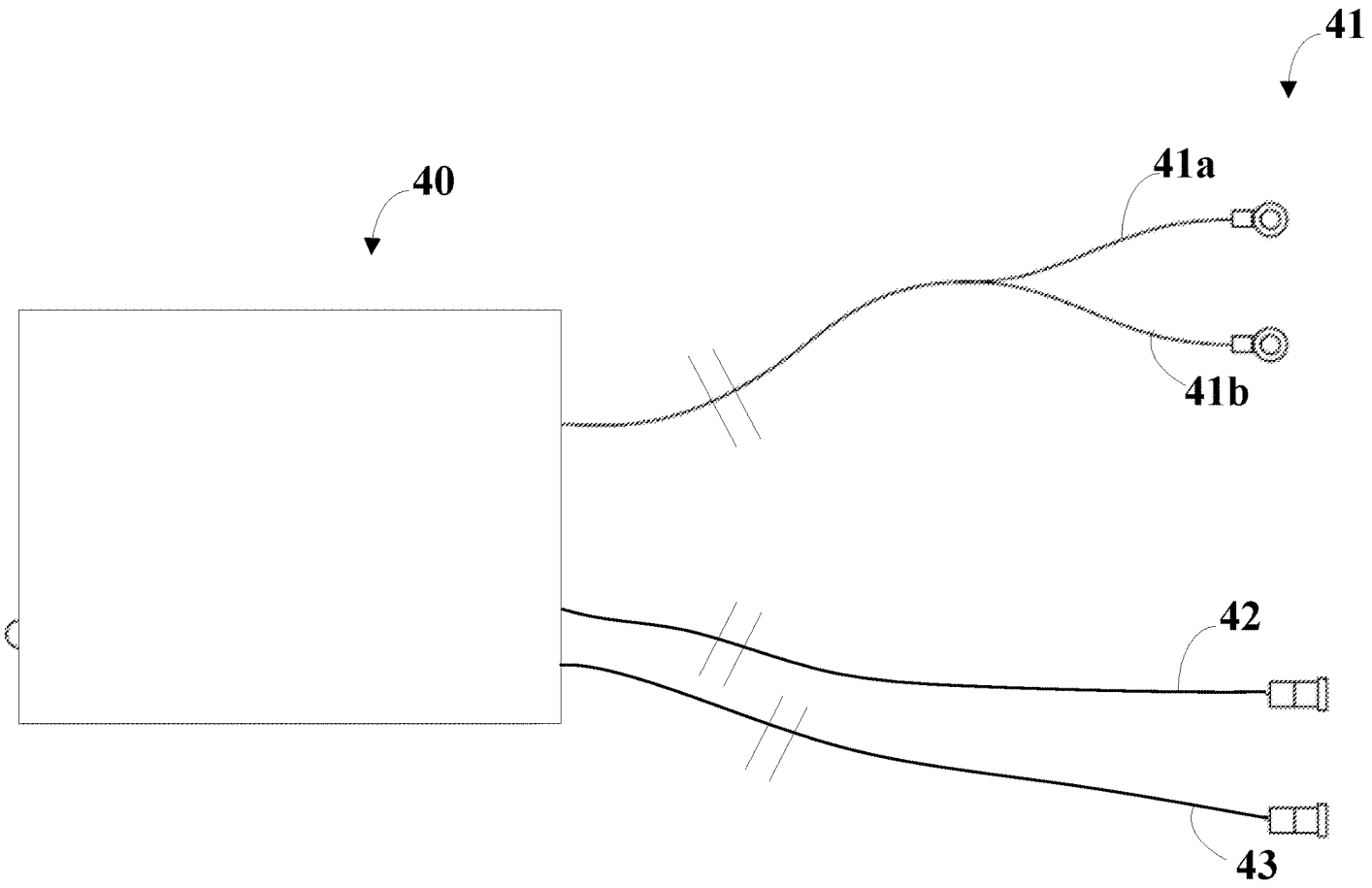
FIG. 3 is a schematic view of a control assembly useable in accord with certain techniques according to the present disclosure.

A control assembly for affecting this link is indicated schematically in FIG. 3 at 40. A retrofit of the control equipment 40 to an existing system will be understood, in general, from the following, and by reference to FIGS. 4-8.

Figure 4:
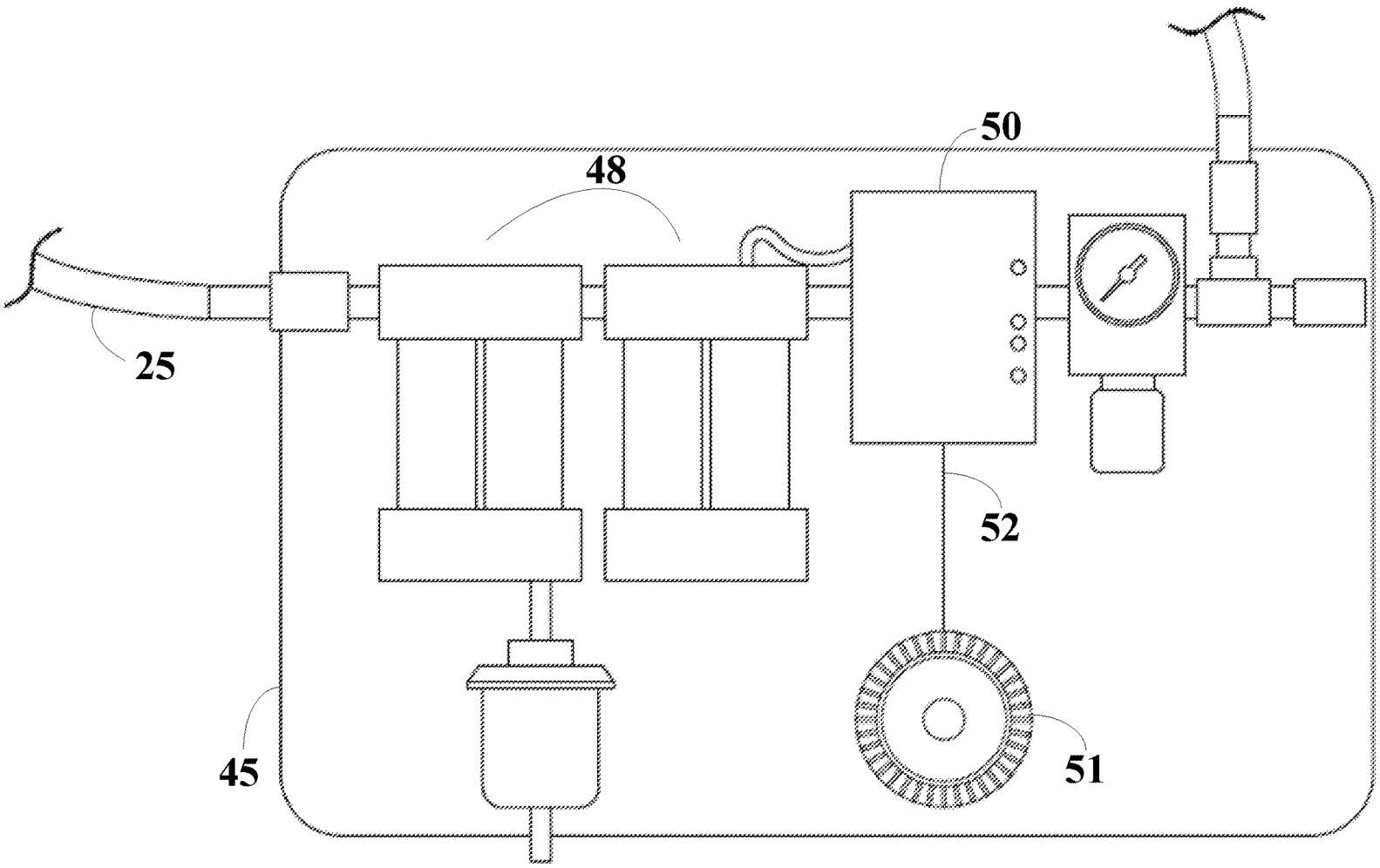
FIG. 4 is a schematic view of a respirator system usable with selected techniques according to the present disclosure.

Referring to FIG. 4, a typical respirator air filtration system is indicated at 45. It can be, for example, positioned on the mobile platform 5, FIG. 1, or carried in a case such as case 38, FIG. 2. The respirator air filtration system 45 receives air from the compressor via line 25, as discussed above. The respirator feed air is passed through a filtration system or arrangement 48. Eventually, the filtered air is directed to line 16, through which it is directed to the respirator equipment (hood or mask) 15, FIGS. 1 and 2. Typically, a pressure regulator is provided in the system, for the personnel 10 to adjust air flow in the hood or mask 15 to a desired level. This regulator may be carried by the personnel 10, or may be on the mobile platform 5.

At 50, an air quality monitor or monitoring system is provided. In general, it is operably positioned downstream from the filter system 48, and is configured to detect the air quality within the filtered air. A variety of techniques can be used for air quality evaluation, including ones now known or later developed. Examples include: opto-chemical sensors, biomimetic sensors, electrochemical sensors, and semiconductor sensors. Although alternatives are possible, these sensors may be used to detect a concentration of a particular gas (e.g., carbon monoxide) in the air.

As an example, in general, the monitoring equipment 50 will be configured so that if an undesired air quality is detected, for example by contaminant presence above some level (e.g., a carbon monoxide level above 5-10 parts per million), an alarm signal is provided. In the example indicated, a typical prior art system is shown along with audible alarm 51 configured to operate upon receiving an appropriate alarm signal (or direction) via cable assembly 52 from the monitoring equipment 50.

Figure 5:
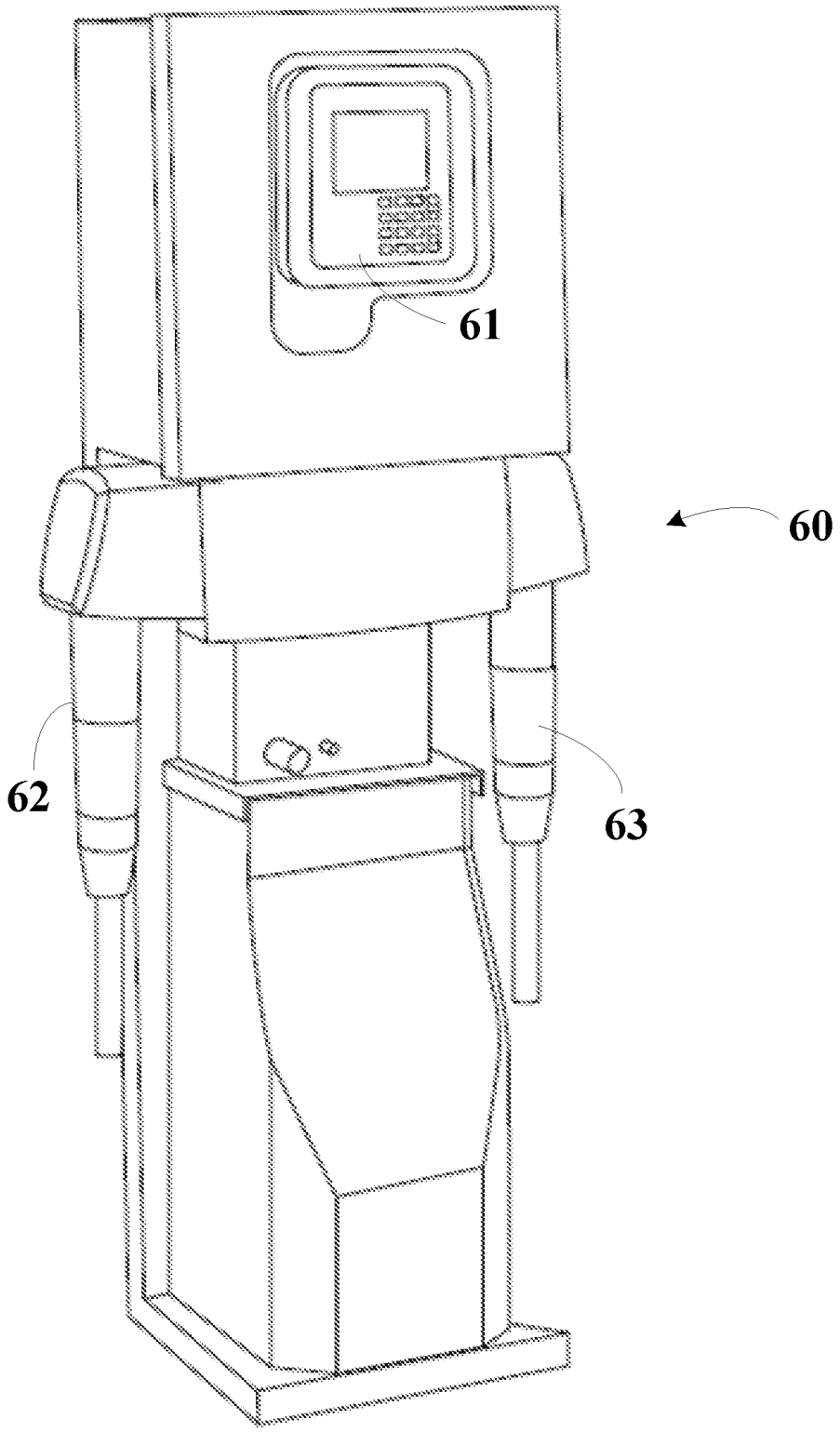
FIG. 5 is a schematic perspective view of an example material application equipment control system usable with techniques of the present disclosure.

Referring now to FIG. 5, example material control and dispensing equipment is indicated schematically at 60. The material dispensing equipment (sometimes characterized as a reactor, depending on the nature of the material being applied) generally includes various control arrangements 61 and material conduit arrangements represented at 62, 63, receiving material from various sources and directing that material out to the application personnel via conduit (line) arrangement 12, FIG. 1.

The distribution equipment or reactor 60 may include, for example, appropriate control arrangements for managing material mixture, temperature, dispensing flow rate, pressure, etc. A typical equipment system 60, when included with current mobile platforms, usually includes various monitoring systems, for example: temperature monitoring, mixture monitoring, application rate monitoring, pressure monitoring, and other monitoring systems. Some embodiments also include one or more communication systems that operate to send and receive data to other equipment. If an inappropriate condition is detected by one of the monitoring systems with respect to the material, the equipment 60 is configured to modify (for example shut down) dispensing flow to the distributor 8, FIG. 1, in a manner that would be immediately detected by the personnel 10 even when remote from the dispensing equipment 60. Alternatively, in some embodiments, if the communication systems is unable to communicate with the other systems (e.g., a data communication line is interrupted), the equipment 60 is configured to modify (e.g., alter, shut down, etc.) dispensing flow to the distributor 8. Thus, attention of the personnel is immediately directed to the problem, requiring the personnel to typically return to the mobile rig 5 for investigation. The equipment 60 is typically provided with a monitor panel, to immediately advise the personnel of the system issue.

Figure 6:
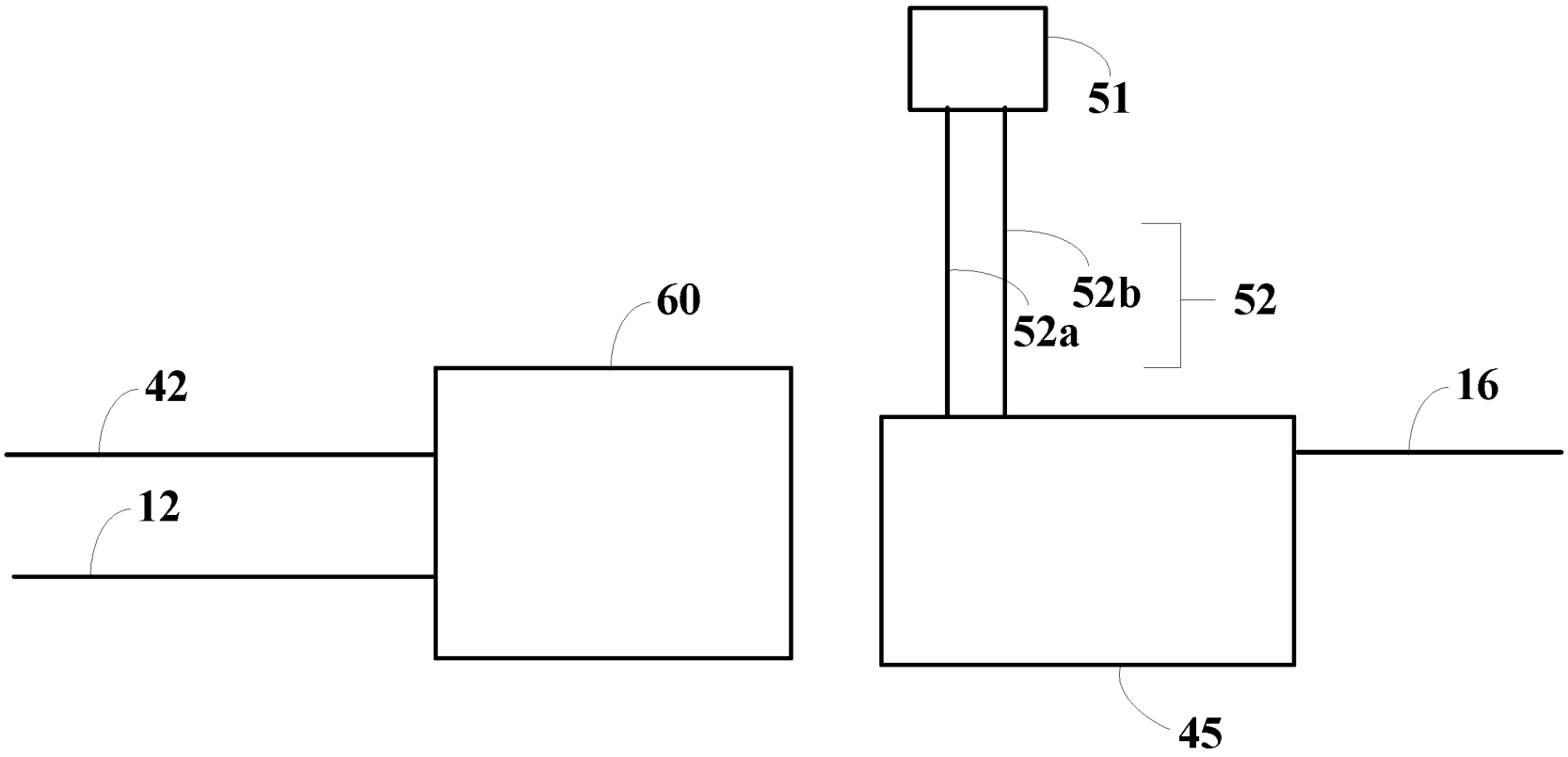
(PRIOR ART) FIG. 6
FIG. 6 is a schematic depiction of the prior art material application and respiratory control system that can be improved by applications of the techniques characterized herein.

In FIG. 6, a schematic operation of the two systems in a PRIOR ART practice is shown, i.e., the material dispensing equipment 60 and the respirator system 45 are shown, with the two being independent (except in some instances, with operation using compressed air from the same compressor system and/or power from the same generator). The respirator system 45 is connected to the audible alarm 51 by the cable assembly 52, which includes lines 52*a* and 52*b*. The material dispensing system 60 includes a temperature signal cable assembly 42.

Figure 7:
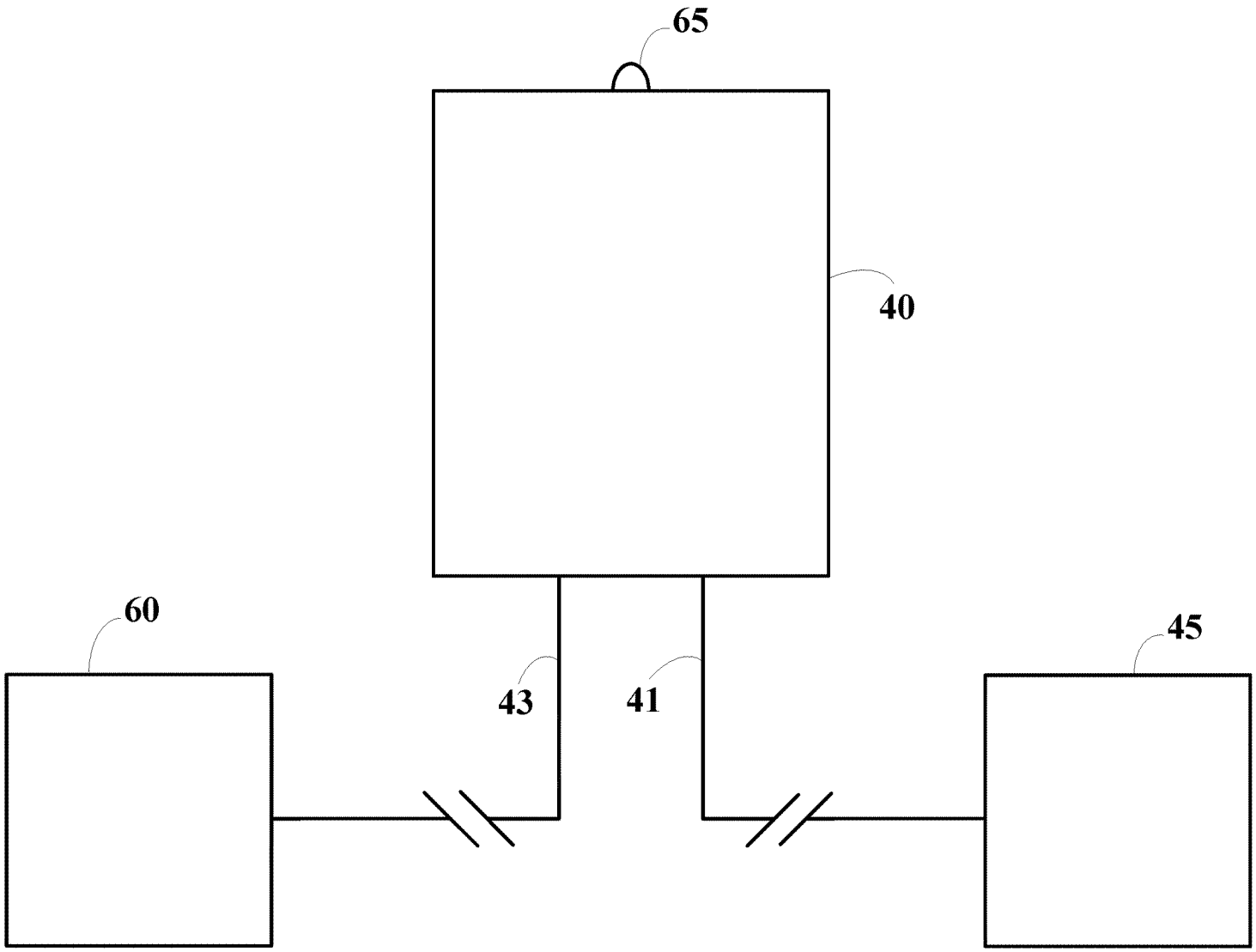
FIG. 7 is an enlarged schematic view depicting a control assembly in accord with FIG. 3 positioned in association with a respirator system and material application system in general accord with FIG. 6, to result in an improved system.

In FIG. 7, a modification to the separated systems of FIG. 6, is shown, in accord with the present disclosure, with control assembly 40 linked to the respirator system 45 (via cable assembly 41) and linked to the dispensing equipment 60 (via cable assembly 43). The linking can be conducted in a variety of manners, as detailed below.

For example, the control assembly 40 can be configured to receive a signal related to a condition of the air of the respirator system 45 via cable assembly 41. The control assembly 40 can also be configured to send a control signal to the dispensing equipment 60 via the cable assembly 43. The control signal may be based on the signal related to the condition of the air of the respirator system 45. For example, based upon receiving a signal over the cable assembly 41 indicating an undesirable condition of the air from the respirator system 45, the control assembly 40 may transmit a control signal over the cable assembly 43 that causes the dispensing equipment 60 to shutoff or otherwise interrupt flow to the distributor.

The control assembly 40 can be provided with an optional indicator system such as light 65 that would turn on or flash (signal) if the switch in operation of the dispensing equipment occurred as result of a signal of improper condition from the respirator equipment 45. Thus, the operator 10, remote at the site, who would return to the vehicle or mobile platform 5 upon the otherwise unexplained automatic shutting down or modification of the material dispensing equipment, would be able to detect immediately whether it was the respirator system 45 that led to (triggered) the shutdown, or one of the control mechanisms with respect to the material distribution. This may be beneficial when the control assembly 40 is retrofit to existing equipment, as will be described in greater detail below, because the dispensing equipment 60 may include a display panel that attributes the shutdown to another cause.

Figure 8:
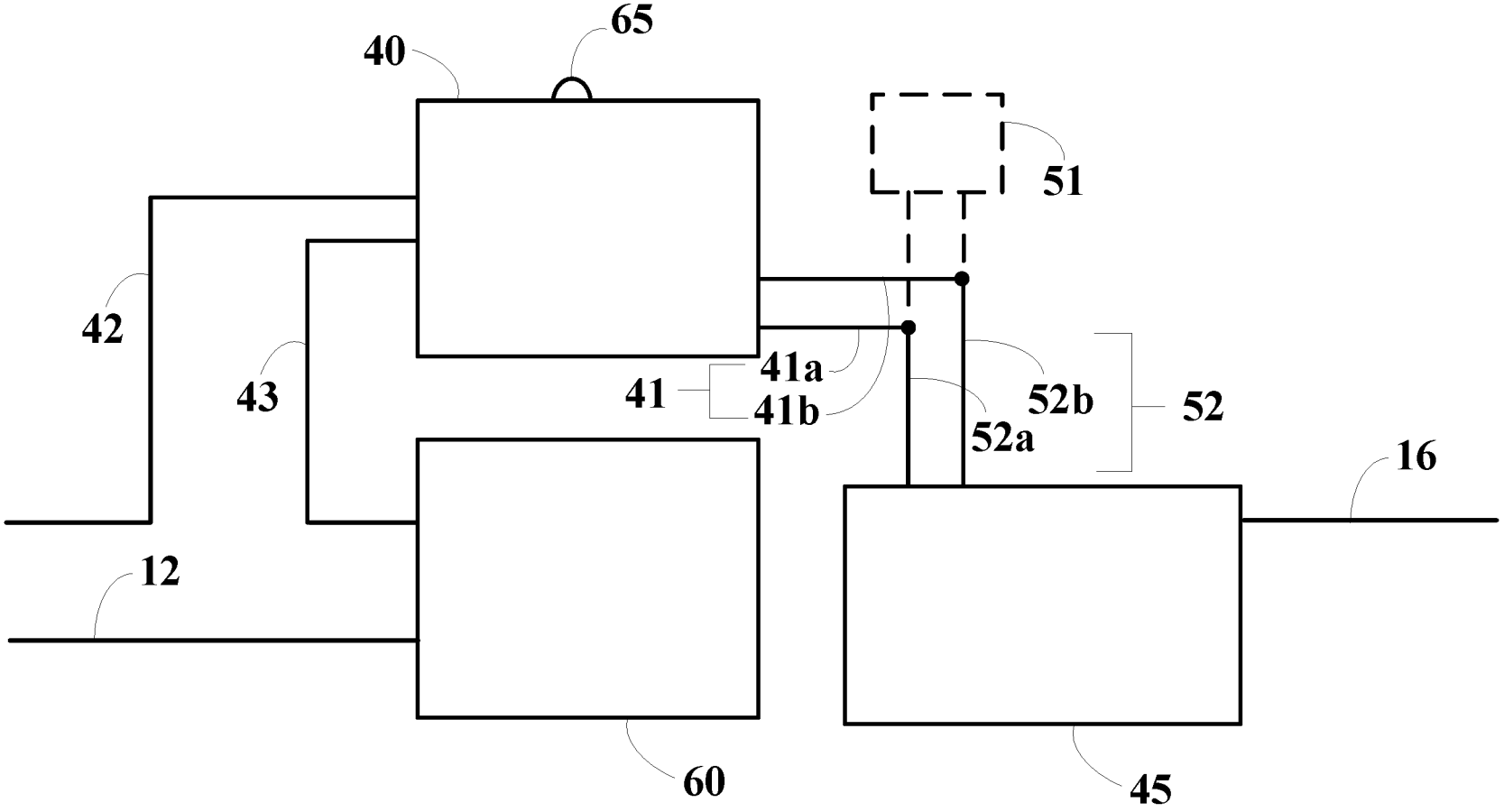
FIG. 8 is a schematic view depicting, in an example, more detail of the system of FIG. 7.

In FIG. 8, then, a schematic depiction is provided showing the control equipment 40 tapped into (retrofit to) existing dispensing equipment 60 via a line that relates to a signal of concern to some otherwise already existing monitoring/control/communication system of the dispensing equipment 60, such as the temperature signal cable assembly 42. It also shows the control equipment 40 tapped into the respirator system 45 via cable assembly 41 which is connected to the cable assembly 52.

For example, the dispensing equipment 60 can be configured with a temperature regulation system in which a signal is sent (via the temperature signal cable assembly 42) from temperature monitoring equipment to the control equipment 60 in a continuous manner. The temperature monitoring equipment may be part of the distributor 8 or it may be attached to the line 12. The signal may be altered or interrupted (for example when an undesired temperature situation is detected) causing a shutdown of other modification of material flow from the dispensing equipment. In the example depicted, the control link equipment 40, between the respirator system 45 and the dispensing equipment 60, is connected to the temperature signal cable assembly 42. The control link equipment 40 is then connected to the dispensing equipment 60 through the cable assembly 43. In normal operation, the temperature signal would go from the temperature monitor though cable assembly 42, through control assembly 40 (where it passes unaltered), through line 43, and to the control arrangement of the dispensing equipment 60. If an undesired temperature condition is detected or the temperature signal is disconnected, the flow of the signal through cable assemblies 42 and 43 will be affected, leading to the shutoff or modification of the dispensing equipment.

The control equipment 40, however, is also configured to cause a shutdown in the signal through cable assembly 43 if the respirator equipment 45 detects an undesired air condition within the respirator system. As to the dispensing equipment 60, the control operation would be the same as if it received an improper temperature condition signal. The net effect would be the same as well, i.e., the dispensing equipment 60 would be shut down or modified. However, the cause of the signal change, instead of being the material temperature monitoring system, would be the respirator monitoring system contained within the respirator system 45 and communicating with the control equipment 40 via the cable assemblies 41 and 52.

Although alternatives are possible, the control equipment 40 can receive a signal corresponding to the condition of the air in the respirator system 45 via cable assembly 41. In this example, cable assembly 41 includes lines 41*a* and 41*b*. Lines 41*a* and 41*b* tap into (or connect to) lines 52*a* and 52*b* respectively, of the cable assembly 52. As described above, the cable assembly 52 connects the respirator system 45 to the audible alarm 51. When an unsatisfactory condition of the air is detected by the respirator system 45, the signal is transmitted via cable assembly 52 to the audible alarm 51. The cable assembly 41 receives the signal as well and transmits the signal to the control equipment 40. Although in this example, cable assembly 41 taps into cable assembly 52, other embodiments are possible where cable assembly 52 is simply diverted to the control equipment 40, which has the effect of bypassing the audible alarm 51 altogether.

As described above, the control assembly 40 can be provided with an optional indicator system such as light 65 that would turn on or flash (signal) if the switch in operation of the dispensing equipment occurred as result of a signal of improper condition from the respirator equipment 45. In this example, the indicator system can help the operator 10 to immediately distinguish between an actual error from the temperature monitoring system (or other monitoring or communication system) and an error triggered by the respirator system 45.

D. Some Variations in Control System Installation/Methodology

1. Modification in Application with Respect to the Existing Equipment Monitor in which Tapping or Retrofitting Occurs Herein above, an example temperature monitor system for existing dispensing equipment was described as an example system, in which a controller 40 according to the present disclosure could be implemented. Of course, the dispensing equipment 60 can be provided with other monitoring or communication systems in which such a tap or retrofit can be applied, using the same techniques. Examples of such systems include: material mixture monitoring systems, application or flow rate monitoring systems, pressure monitoring systems, environmental monitoring (ambient temperature, humidity, etc.) systems, other monitoring systems, and communication systems for communication from the dispensing equipment 60 to other equipment.

2. Variations in the Electronic Signal Use/Modification

In the discussion above, various cable assemblies (e.g., cable assemblies 41, 42, 43 and 52) carried signals to and from the control equipment 40. The cable assemblies can include one or more signal lines such as wires or conductors for transmitting electronic signals. The cable assemblies can take various forms and may be as simple as pair of wires in which a signal is transmitted as a voltage. The pair of wires may form a twisted pair or may not be twisted. Additionally, the cable assemblies may be shielded or unshielded. Alternatively, the cable assembly may include additional lines. For example, the cable assemblies may include seven lines. The cable assembly may be a thermostat cable or other type of cable, such as category 3 (cat 3), category 4 (cat 4), category 5/category 5 enhanced (cat 5/5e), category 6/category 6 augmented (cat 6/6a), category 7/category 7 augmented (cat 7/7a), or category 8/8.1/8.2 (cat 8/8.1/8.2). Other types of cable are possible as well.

Alternatively, wireless communication technology may be used instead of some or all of the cable assemblies 41, 42, 43, and 52. Examples of wireless communication technology include infrared, BLUETOOTH® wireless technology, 802.11a/b/g/n/ac, ultra-wideband (UWB), ZigBee, cellular, or other radio frequency or optical communication systems.

3. Application with Modified Equipment

In Section C above, a description was provided of a method of retrofitting existing equipment, such as material dispensing arrangement, with a control arrangement according to the present disclosure. Because currently manufactured dispensing equipment (or other types of equipment) does not have a control system for respirator monitoring, the controller arrangement was tapped into a retrofit to the dispensing system by using one of the monitoring or communication systems the material dispensing equipment did have, for example, a temperature monitoring system. By tapping into that system, one can take advantage of the preexisting monitoring signal/quit operation system of the material dispensing system (or other equipment), but for a different purpose, i.e., the purpose of reacting to the condition of the separate respirator system.

As practices with the techniques described herein become widespread, dispensing equipment (and other equipment) will eventually be manufactured or assembled to include a logic system and control features specifically for a monitoring and operation change with respect to a perhaps separate and remote respirator system operation. When this is the case, the direct linking can be used with signal lines from the respirator monitoring system to appropriate electronic terminal, connectors, etc. (signal receivers) in the dispensing equipment (or other equipment). The same logic for operation would be involved, but it would likely not be necessary for use of a separate control box as shown in FIG. 3 at 40, since that monitoring logic would already be subsumed in the material reactor or dispenser equipment (or other equipment), and the control panel of that equipment would be configured to show that it was a respirator system signal that caused the shutdown or equipment modification, rather than some separate cause such as temperature monitoring or a communication system error.

4. Types of Equipment

Herein above, an existing dispensing equipment was described as an example system, in which a controller 40 according to the present disclosure could be implemented. Of course, many different types of equipment can be configured based on the techniques of the present disclosure. Non-limiting examples of equipment include: spray foam insulation installation equipment, pressurized abrasive spray equipment (e.g., sand blaster equipment), paint or coating applicator equipment, cleaning equipment (e.g., power washers and spray cleanser applicators), welding equipment, and other types of tools or equipment in which respiratory protection is necessary or desirable.

II. Example Electronics and Logic Diagrams, FIGS. 9-12

Figure 9:
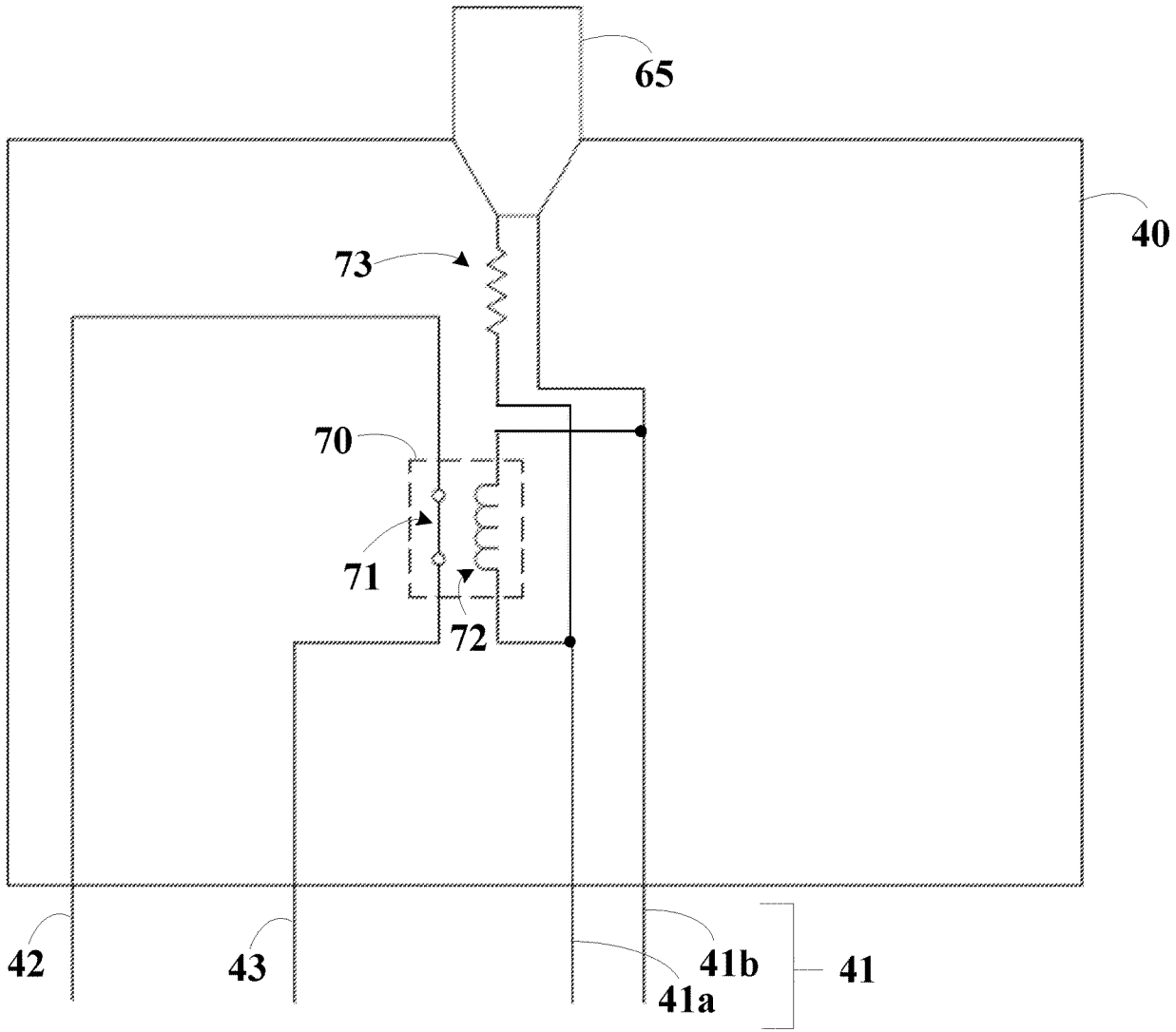
FIG. 9 is a schematic view of example electronics usable with the control assembly according to FIG. 3.

In FIG. 9, an electronic diagram of an example of the control equipment 40 is shown.

Although many of the examples described herein relate to material application, the examples can be applied to the operation of other equipment as well. The control equipment includes connections to the cable assemblies 41, 42, and 43. The cable assemblies 42 and 43 may be connected to one another and carry a signal used for controlling or monitoring a signal from the dispensing equipment 60. The cable assembly 41 includes the lines 41*a* and 41*b*. The cable assembly 41 may carry a signal representing the condition of the air from the respirator 45. Although alternatives are possible, the control equipment 40 includes an electronic switch 70 and a resistor 73. The electronic switch 70 is controlled by the signal carried by the cable assembly 41 (e.g., an air quality signal). In this example, the electronic switch 70 is an electronic relay that includes a switch 71 and an inductor 72. By default, the switch 71 is in a closed position, causing the cable assembly 42 to connect to the cable assembly 43. However, when a voltage differential is applied across the lines 41*a* and 41*b* of cable assembly 41, a current passes between lines 41*a* and 41*b* and through the inductor 72. As the current passes through the inductor 72, the inductor 72 generates a magnetic field, which pulls the switch 71 into an open position and disconnects cable assemblies 42 and 43. Additionally, the current can activate the light 65. In the example shown, the inductor 72 is connected in parallel with the light 65. The resistor 73 can be used to control the current that passes through the light 65. However, some embodiments do not include the resistor 73.

Figure 10:
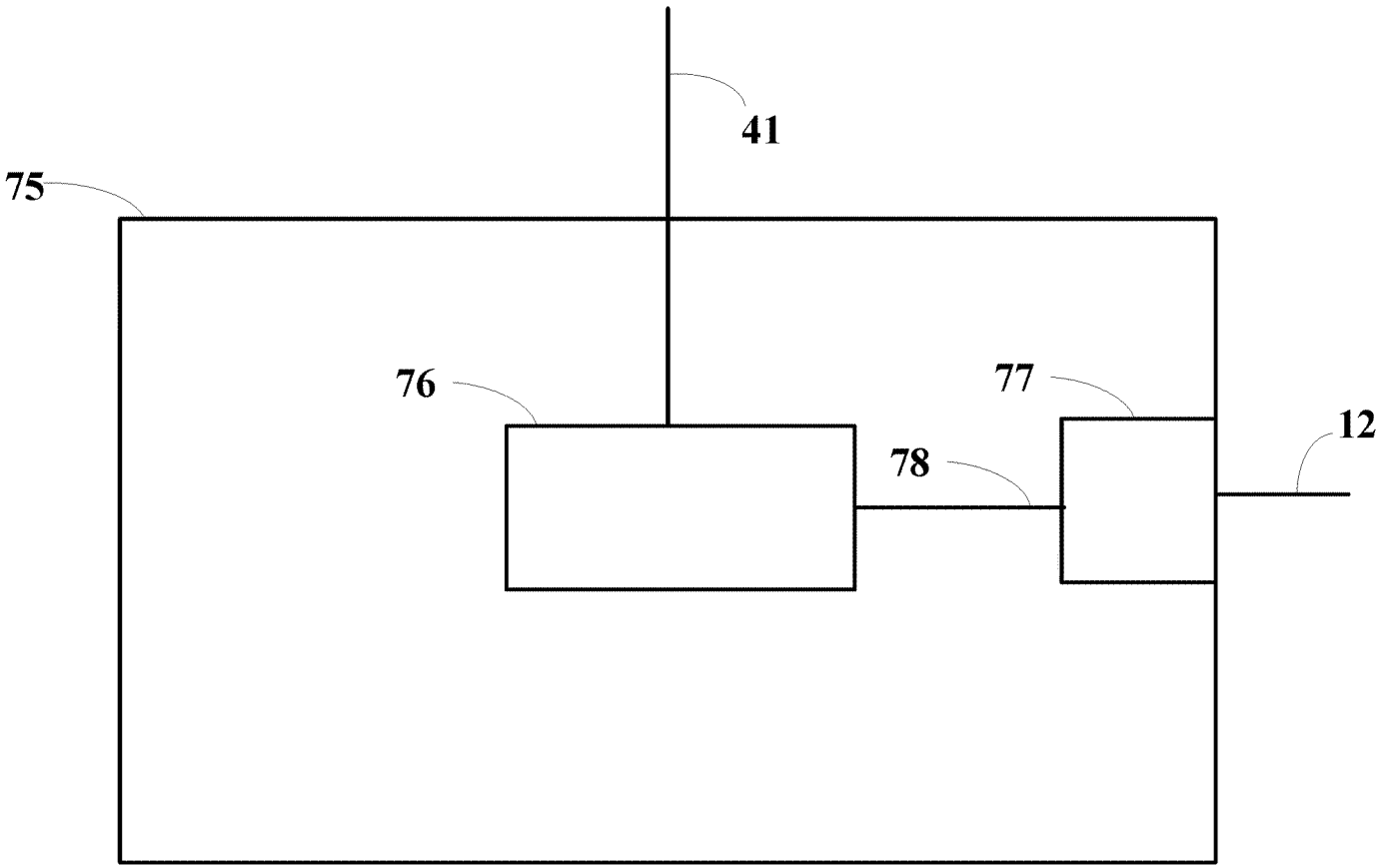
FIG. 10 is a schematic view of an alternate embodiment of the dispensing equipment in accord with the present disclosure.

In FIG. 10, a schematic view of an alternate embodiment of the dispensing equipment is shown at 75. In this embodiment, the dispensing equipment 75 receives a signal from the respirator equipment via cable assembly 41. The signal is based on a condition of the air in the respirator equipment. The dispensing equipment 75 also includes a computing device 76 and a flow control device 77. The computing device 76 receives the signal from cable assembly 41. Additionally, the computing device 76 is connected to the flow control device 77 via cable assembly 78. The flow control device 77 controls the flow through line 12. The computing device 76 can transmit instructions to the flow control device 77 to increase, decrease, stop, or otherwise adjust the flow through line 12. When the computing device 76 receives a signal on cable assembly 41 indicating an unsatisfactory condition of the air, the computing device 76 can transmit an instruction to the flow control device 77 to stop or alter the flow on line 12.

Because the dispensing equipment 75 is configured to receive a signal indicating a status of the breathing equipment, the dispensing equipment 75 can display an appropriate error when an unsatisfactory condition of the air is detected.

Figure 11:
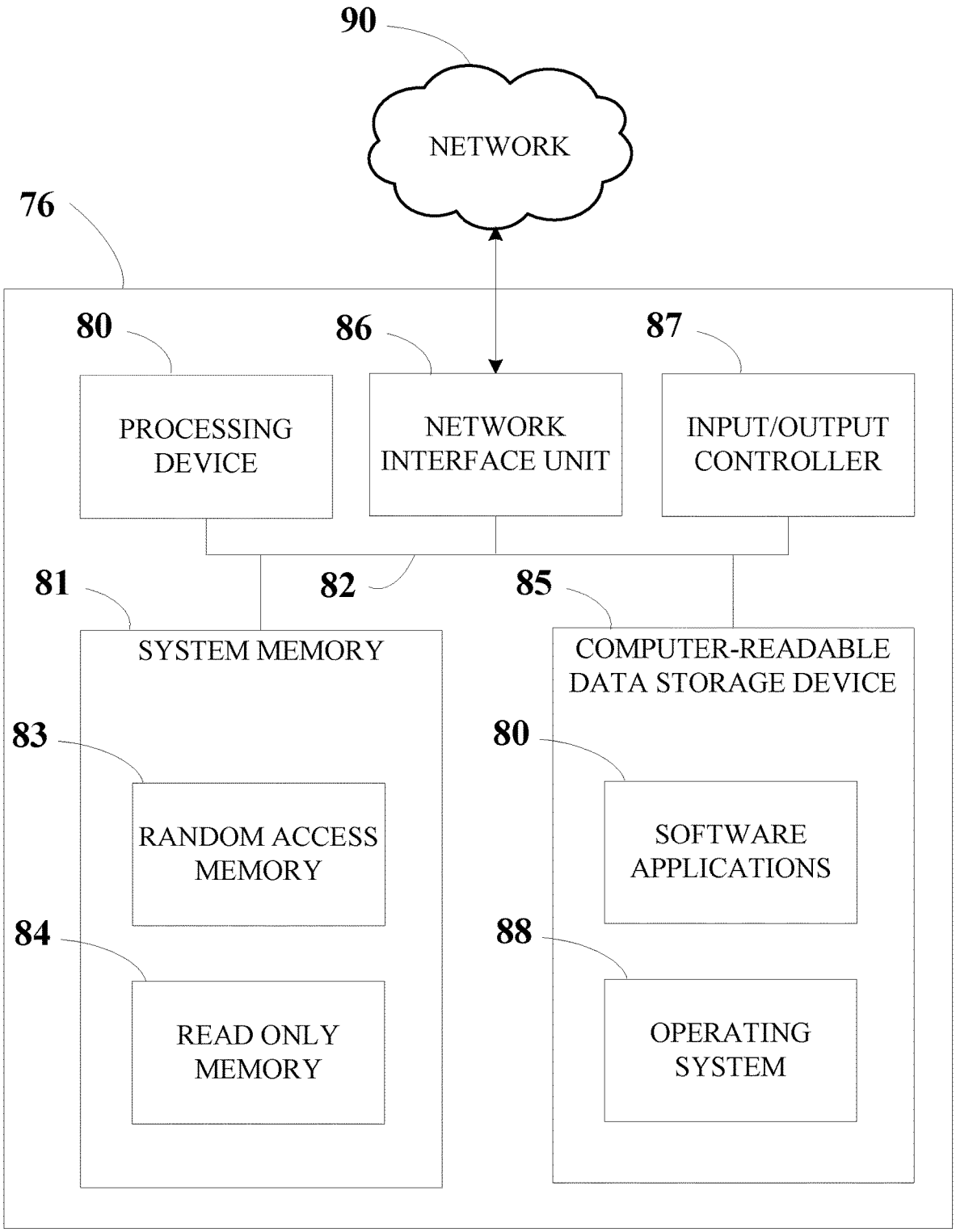
FIG. 11 is a schematic view of a computing device of FIG. 10.

In FIG. 11, a schematic view of the physical components of an example of the computing device 76 is shown. As illustrated, the device includes at least one processing device 80, such as a central processing unit ("CPU"), a system memory 81, and a system bus 82 that couples the system memory 81 to the processing device 80. The system memory 81 includes a random access memory ("RAM") 83 and a read-only memory ("ROM") 84. A basic input/output system containing the basic routines that help to transfer information between elements within the device, such as during startup, is stored in the ROM 84. The device further includes a computer-readable data storage device 85. The computer-readable data storage device 85 is able to store software instructions and data.

The computer-readable data storage device 85 is connected to the processing device 80 through a storage controller (not shown) connected to the bus 82. The computer-readable data storage device 85 and its associated computer-readable data storage media provide non-volatile, non-transitory storage for the device. Although the description of computer-readable data storage media contained herein refers to a mass storage device, such as a hard disk or CD-ROM drive, it should be appreciated by those skilled in the art that computer-readable data storage media can be any available non-transitory, physical device or article of manufacture from which the device can read data and/or instructions.

Computer-readable data storage media include volatile and non-volatile, removable and non-removable media implemented in any method or technology for storage of information such as computer-readable software instructions, data structures, program modules or other data. Example types of computer-readable data storage media include, but are not limited to, RAM, ROM, EPROM, EEPROM, flash memory or other solid state memory technology, CD-ROMs, digital versatile discs ("DVDs"), other optical storage media, magnetic cassettes, magnetic tape, magnetic disk storage or other magnetic storage devices, or any other medium which can be used to store the desired information and which can be accessed by the device.

According to various embodiments of the invention, the device may operate in a networked environment using logical connections to remote network devices through the network 90, such as a local network, the Internet, or another type of network. The device connects to the network 90 through a network interface unit 86 connected to the bus 82. The network interface unit 86 may also be utilized to connect to other types of networks and remote computing systems. The device also includes an input/output controller 87 for receiving and processing input from a number of other devices, including a keyboard, a mouse, a touch user interface display screen, or another type of input device. Similarly, the input/output controller 87 may provide output to a touch user interface display screen, a printer, or other type of output device.

As mentioned above, the computer-readable storage device 85 and the RAM 83 of the device can store software instructions and data. The software instructions include an operating system 88 suitable for controlling the operation of the device. The computer-readable storage device 85 and/or the RAM 83 also store software instructions, that when executed by the processing device 80, cause the device to provide the functionality of the device discussed in this document. For example, the computer-readable storage device 85 and/or the RAM 83 can store software instructions, such as software applications 89 that, when executed by the processing device 80, cause the device to perform as described herein.

Figure 12:
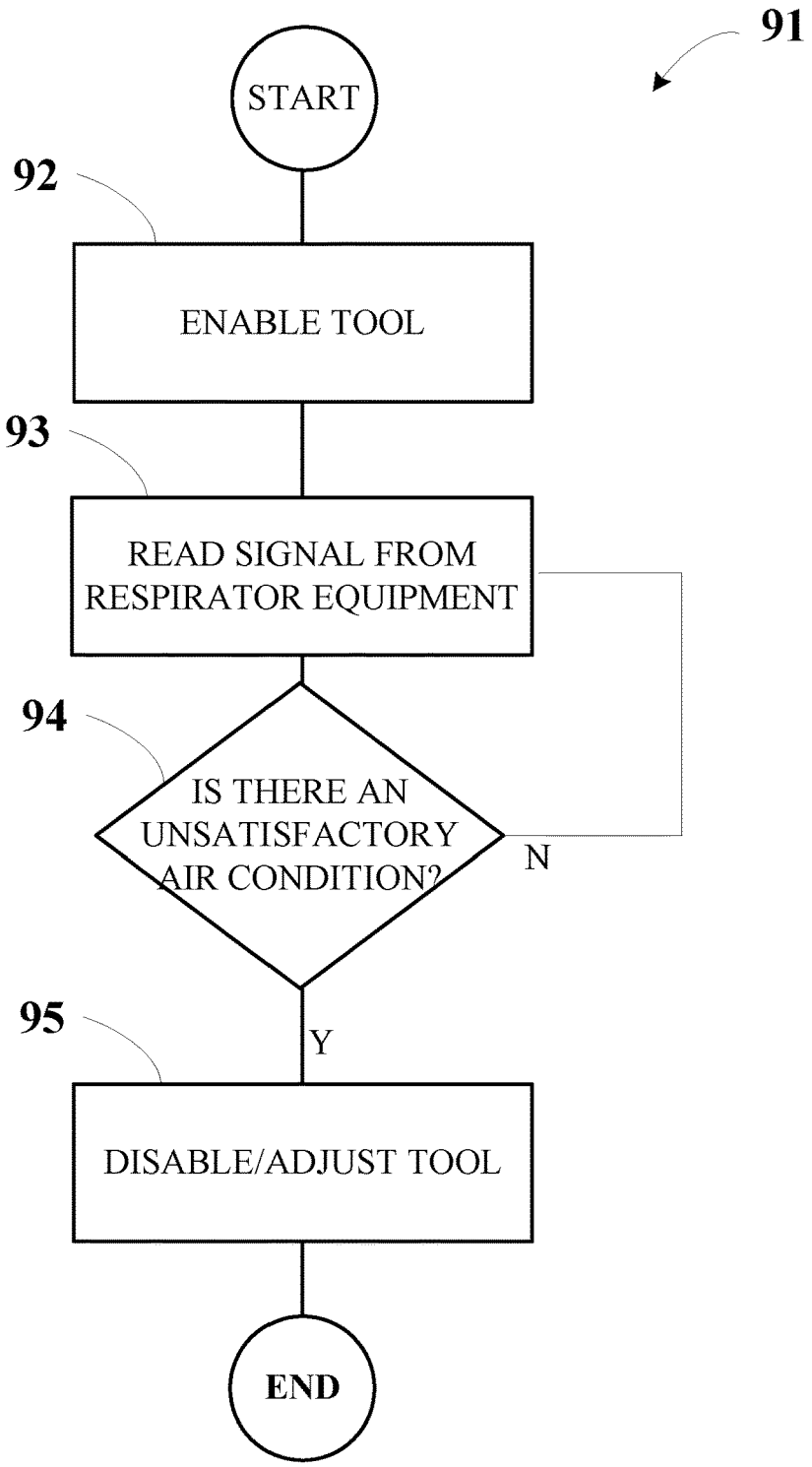
FIG. 12 is a flow chart illustrating an example method of operation of dispensing equipment in accordance with FIG. 10.

FIG. 12 is a flow chart illustrating an example method 91 of operation of some embodiments of the dispensing equipment 75. In this example, the method 91 includes operations 92, 93, 94, and 95. Some of the operations may be performed by the computing device 76.

At operation 92, the tool, such as applicator 8, is enabled. This allows the personnel 10 to distribute the material or otherwise operate the tool at the work site. At operation 93, the signal from the respirator equipment 45 is read. At operation 94, it is determined whether there is an unsatisfactory air condition. If there is an unsatisfactory air condition, the method 91 continues to operation 95, where the tool, such as applicator 8, is adjusted or disabled. If not, the method 91 returns to operation 93.

III. General Comments and Observation

According to the present disclosure, a tool control and breathable air delivery system is provided. In at least one example arrangement described herein, the system comprises equipment including a tool and a controller, the controller configured to control the tool.

The system further includes a wearable respirator. For example, the wearable respirator is hood, mask or other device configured to be worn by personnel applying the material at the work site. The wearable respirator is further configured to provide breathable air to the personnel.

The system further includes an air delivery device connectable to the wearable respirator. For example, the air delivery device may transmit breathable air through an air flow line to the wearable respirator. The system further includes an air evaluation monitor configured to generate an air condition signal based upon a condition of air being delivered to the wearable respirator.

The system further includes an electronic circuit configured to adjust the tool based at least in part on the air condition signal generated by the air evaluation monitor. Adjusting the tool can, for example, mean disabling or stopping the tool otherwise altering the operation of the tool.

In a typical example material and breathable air delivery system of the type previously characterized, the signal is an electronic signal configured to activate an alarm signal and the electronic circuit is configured to adjust the tool by generating an error condition on the controller based on the signal.

In at least one system characterized herein, the controller includes a port configured to receive an electronic signal and the electronic circuit is configured to generate an error condition on the equipment by interrupting the electronic signal. For example, the electronic circuit can tap into a cable assembly carrying an electronic signal. Under normal operation, the controller can transmit the unaltered electronic signal to the controller. As appropriate (such as based on a condition of the air being delivered to the respirator), the electronic circuit can interrupt the electronic signal, causing an error on the controller. In an example, the port is a temperature port configured to receive an electronic temperature signal. In another example, the port is a communication port configured to receive communication signals.

In an example arrangement described herein, the electronic circuit includes a switch that is electrically connected to a first line and a second line. The first list is configured to carry the electronic signal. The second line is electrically connected to the port. A control port of the switch is connected to a third line. The third line is configured to carry the air condition signal. By the term "air condition signal," in this context, reference is meant to the signal generated by air evaluation monitor based on a condition of the air being delivered to the wearable respirator. The switch is configured to electrically disconnect the first line and the second line when the air condition signal indicates an unsatisfactory condition of the air. The switch is further configured to electrically connect the first line and the second line otherwise. As an example, receiving or not receiving the air condition signal on the control port may indicate an unsatisfactory condition of the air.

Also, in accord with the examples described herein, the switch includes a relay. That is, the switch includes an electric relay.

In at least one system characterized herein, the electronic circuit is integral with the controller. By the term "integral," in this context, it is meant that the electronic circuit is part of the controller.

In a typical example system of the type previously characterized, the air evaluation monitor is configured to generate the signal based upon the condition that the air includes a concentration of a contaminant exceeding a threshold. In some examples, the air evaluation monitor is configured to generate the signal based upon the condition that the air includes a concentration of carbon monoxide exceeding the threshold. Further, in some examples, the air evaluation monitor is configured to generate the signal based upon the condition that the air includes a concentration of carbon monoxide exceeding a threshold in the range of 5 to 10 parts per million. That is, the signal is generated when the concentration of carbon monoxide in the air being delivered to the wearable respirator exceeds a threshold value between 5 parts per million and 10 parts per million.

In an example arrangement described herein, the equipment is dispensing equipment and is configured to deliver a material of a type selected from a group of material types comprising: foam insulation; paint; spray coating; spray abrasive; and cleanser.

In a typical example system of the type previously characterized, the electronic circuit is configured to adjust the tool by disabling the tool.

According to another aspect of the present disclosure, an apparatus configured to adjust an tool based on detection of a condition of air provided to a respirator, is provided. The apparatus includes a switch, a first port configured to connect to a device, a second port configured to connect to a controller, and a control port configured to be connected to a signal line of an air evaluation monitor. The switch is configured to disconnect the first port and the second port based on a signal on the signal line indicating a condition and to connect the first port and the second port based on the signal on the signal line not indicating the condition.

In an example arrangement described herein, the device is a monitoring device. And in a typical example, the monitoring device is a temperature detection device.

Also, in accord with the examples described herein, the signal line is an alarm signal line. In a typical apparatus of the type previous characterized, the apparatus also includes a light source connected to the alarm signal line and configured to activate if an alarm is indicated on the alarm signal line.

According to yet another aspect of the present disclosure, a method of ensuring air provided for respiration is not contaminated is provided. The method includes enabling the tool, providing air to a respirator, determining a condition of the air, and adjusting the tool based on the condition. In accord with at least some examples disclosed herein, adjusting the tool based on the condition includes disabling the tool.

In a typical example method of the type previously characterized, the condition is determined by an air evaluation monitor. The method further includes sending, by the air evaluation monitor, a signal to the controller based on the condition. In some examples, the signal is an electronic signal.

In an example method described herein, the method further includes sending an electronic activation signal to an audible alarm based on the condition, and triggering an error condition on a controller of the tool based on detecting the electronic activation signal.

Another aspect provided by the present disclosure is a method of configuring equipment to ensure breathable air is provided by a respirator during operation. The equipment comprises a tool and a controller. The method includes connecting the control port of a switch to a signal line of an air evaluation monitor that is connected to an air flow line of the respirator. The method further includes connecting a first port of the switch to a device. Additionally, the method includes connecting a second port of the switch to a port of the controller. As an example, this method can be used to retrofit existing equipment with capabilities disclosed herein.

In an example method of the type previously characterized herein, the port of the controller is a temperature input port.

According to yet another aspect of the present disclosure, an equipment rig configured to provide breathable air is provided. The rig includes an air delivery device configured for connection with a wearable respirator. The rig further includes equipment including a controller. The controller is configured to control a communication line to a tool. The controller includes a port configured to receive a signal based on a condition of air delivered to the wearable respirator. Additionally, the controller is configured to adjust the tool based upon the signal.

According to an aspect of the present disclosure, a portable breather panel for use with a wearable respirator while using equipment is provided. The portable breather panel includes an air input port and an air output port. The air output port is configured to deliver air to the wearable respirator. The portable breather panel further includes an air evaluation monitor connected downstream of the air output port. The air evaluation monitor is configured to determine a condition of the air and generate an electronic signal based on the condition. The portable breather panel also includes a communication interface. The communication interface is configured for communication with the equipment. Additionally, the portable breather panel includes an electronic circuit. The electronic circuit is connected to the air evaluation monitor and the communication interface. Further, the electronic circuit is configured to transmit an alarm signal to the equipment using the communication interface based at least in part on the signal generated by the air evaluation monitor.

Another aspect provided by the present disclosure is tool control equipment. The tool control equipment includes a tool and a controller. The controller is configured to control the tool. The controller includes a port configured to receive a signal based on a condition of air delivered to a wearable respirator. Additionally, the controller is configured to adjust the tool based upon the signal.

In an example arrangement described herein, the controller includes at least one processing device and at least one computer-readable data storage device. The at least one computer-readable data storage device storing instructions that, when executed by the at least one processing device, cause the controller to enable the tool, receive the signal, and adjust the tool based on the signal.

Also, in accord with the examples provided herein, the equipment further includes a display panel. The at least one computer-readable data storage device further storing instructions that, when executed by the at least one processing device, cause the equipment to display a message based on the signal.

In accord with other examples provided herein, the equipment further includes an indicator. The equipment is configured to adjust the indicator based on the signal. In some examples, the indicator is a light-emitting diode.

According to the present disclosure, a material and breathable air delivery system is provided. In at least one example arrangement described herein, the material and breathable air delivery system comprises dispensing equipment including a controller configured to control delivery of the material and an applicator configured to apply the material. For example, the dispensing equipment dispenses the material to the applicator in accordance with instructions from the controller.

The material and breathable air delivery system further includes a wearable respirator. For example, the wearable respirator is hood, mask or other device configured to be worn by personnel applying the material at the work site. The wearable respirator is further configured to provide breathable air to the personnel.

The material and breathable air delivery system further includes an air delivery device connected to the wearable respirator. For example, the air delivery device may transmit breathable air through an air flow line to the wearable respirator.

The material and breathable air delivery system further includes an air evaluation monitor connected upstream of the wearable respirator, wherein the air evaluation monitor is configured to generate a signal based upon a condition of the air being delivered to the wearable respirator. By the term "upstream," in this context, it is meant that the air evaluation monitor can access the air before the air is delivered to the wearable respirator.

The material and breathable air delivery system further includes an electronic circuit configured to adjust the applicator based at least in part on the signal generated by the air evaluation monitor. Adjusting the applicator can, for example, mean disabling or stopping the flow of material to the applicator or otherwise altering the flow of material or the operation of the applicator.

According to another aspect of the present disclosure, an apparatus configured to adjust an applicator based on detection of a condition of air provided to a respirator, is provided. The apparatus includes a switch, a first port configured to connect to a device, a second port configured to connect to a controller, and a control port configured to be connected to a signal line of an air evaluation monitor. The switch is configured to disconnect the first port and the second port based on a signal on the signal line indicating a condition and to connect the first port and the second port based on the signal on the signal line not indicating the condition.

According to yet another aspect of the present disclosure, a method of ensuring air provided for respiration is not contaminated while providing material from dispensing equipment is provided. The dispensing equipment includes a controller and an applicator. The method includes enabling the applicator, providing air to a respirator, determining a condition of the air; and adjusting the applicator based on the condition. In accord with at least some examples disclosed herein, adjusting the applicator based on the condition includes disabling the applicator.

Another aspect provided by the present disclosure is a method of configuring dispensing equipment to ensure air provided to a respirator is not contaminated while providing material from the dispensing equipment. The dispensing equipment comprises a controller and an applicator. The method includes connecting the control port of a switch to a signal line of an air evaluation monitor that is connected to an air flow line of the respirator. The method further includes connecting a first port of the switch to a device. The device may be a temperature monitoring device. Alternatively the device may be equipment that is configured to communicate with the controller. Additionally, the method includes connecting a second port of the switch to a port of the controller. The port of the controller may be a temperature input port. Alternatively, the port of the controller may be a communication port. As an example, this method can be used to retrofit existing equipment with capabilities disclosed herein.

According to yet another aspect of the present disclosure, a mobile equipment rig configured to provide material and breathable air is provided. The rig includes an air delivery device including a fluidic port configured for connection with a wearable respirator. The rig further includes dispensing equipment including a controller. The controller is configured to control delivery of the material to an applicator. The controller includes a port configured to receive a signal based on a condition of air delivered to the wearable respirator. Additionally, the controller is configured to adjust the applicator based upon the signal.

According to an aspect of the present disclosure, a portable breather panel for use with a wearable respirator while applying material using dispensing equipment is provided. The portable breather panel includes an air input port and an air output port. The air output port is configured to deliver air to the wearable respirator. The portable breather panel further includes an air evaluation monitor connected downstream of the air output port. The air evaluation monitor is configured to determine a condition of the air and generate an electronic signal based on the condition. The portable breather panel also includes a communication interface. The communication interface is configured for communication with the dispensing equipment. Additionally, the portable breather panel includes an electronic circuit. The electronic circuit is connected to the air evaluation monitor and the communication interface. Further, the electronic circuit is configured to transmit an alarm signal to the dispensing equipment using the communication interface based at least in part on the signal generated by the air evaluation monitor.

Another aspect provided by the present disclosure is dispensing equipment configured to provide material. The dispensing equipment includes an applicator and a controller. The controller is configured to control delivery of the material to the applicator. The controller includes a port configured to receive a signal based on a condition of air delivered to a wearable respirator. Additionally, the controller is configured to adjust the applicator based upon the signal.

What is claimed is:

1. A tool control and breathable air delivery system, the system comprising:

a) equipment including a tool and a controller, the controller configured to control the tool;

b) a wearable respirator;

c) an air delivery device connectable to the wearable respirator;

d) an air evaluation monitor configured to generate an air condition signal based upon a condition of air being delivered to the wearable respirator; and e) an electronic circuit configured to adjust the tool based at least in part on the air condition signal;

f) wherein the equipment is dispensing equipment and is configured to deliver a material of a type selected from a group of material types consisting of: spray coating, spray abrasive, and cleanser.

2. The system of claim 1, wherein the air condition signal is an electronic signal configured to activate an alarm signal and the electronic circuit is configured to adjust the tool by generating an error condition on the controller based on the air condition signal.

3. The system of claim 2, wherein the controller includes a port configured to receive the electronic signal and the electronic circuit is configured to generate an error condition on the equipment by interrupting the electronic signal.

4. The system of claim 3, wherein the port is a temperature port configured to receive an electronic temperature signal.

5. The system of claim 3, wherein the port is a communication port configured to receive communication signals.

6. The system of claim 3, wherein the electronic circuit includes a switch that is electrically connected to a first line and a second line, the first line configured to carry the electronic signal and the second line electrically connected to a port of the controller, wherein a control port of the switch is connected to a third line, the third line configured to carry the air condition signal, the switch being configured to electrically disconnect the first line and the second line when the air condition signal indicates an unsatisfactory condition of the air, and to electrically connect the first line and the second line otherwise.

7. The system of claim 6, wherein the switch includes a relay.

8. The system of claim 1, wherein the electronic circuit is integral with the controller.

9. The system of claim 1, wherein the air evaluation monitor is configured to generate the air condition signal based upon the condition that the air includes a concentration of a contaminant exceeding a threshold.

10. The system of claim 9, wherein the air evaluation monitor is configured to generate the air condition signal based upon the condition that the air includes a concentration of carbon monoxide exceeding a threshold.

11. The system of claim 10, wherein the air evaluation monitor is configured to generate the air condition signal based upon the condition that the air includes a concentration of carbon monoxide exceeding a threshold in the range of 5 to 10 parts per million.

12. The system of claim 1 wherein the spray coating includes one or more spray coating materials of a type selected from a group comprising:

foam insulation; and paint.

13. The system of claim 1, wherein the electronic circuit is configured to adjust the tool by disabling the tool.

* * * * *